US010801400B2

(12) United States Patent
Jost et al.

(10) Patent No.: US 10,801,400 B2
(45) Date of Patent: Oct. 13, 2020

(54) METHOD AND DEVICE FOR WATER INJECTION

(71) Applicant: Dr. Ing. h.c. F. Porsche Aktiengesellschaft, Stuttgart (DE)

(72) Inventors: Philip Jost, Stuttgart (DE); Timo Poggemann, Keltern (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 0 days.

(21) Appl. No.: 16/258,855

(22) Filed: Jan. 28, 2019

(65) Prior Publication Data

US 2019/0234299 A1 Aug. 1, 2019

(30) Foreign Application Priority Data

Jan. 26, 2018 (DE) ..... 10 2018 101 773

(51) Int. Cl.
*F02D 41/40* (2006.01)
*F02B 47/02* (2006.01)
(Continued)

(52) U.S. Cl.
CPC ..... *F02B 47/02* (2013.01); *F02M 25/028* (2013.01); *F02M 25/0221* (2013.01); *F02M 25/03* (2013.01)

(58) Field of Classification Search
CPC ..... F02B 47/02; F02D 19/12; F02D 41/0025; F02D 41/221; F02M 25/0221; F02M 25/0227; F02M 25/028; F02M 25/03
See application file for complete search history.

(56) References Cited

U.S. PATENT DOCUMENTS 4,010,717 A * 3/1977 Taplin ..... F02D 41/107 123/492
5,460,196 A * 10/1995 Yonnet ..... G05D 16/2095 137/12
(Continued)

FOREIGN PATENT DOCUMENTS

DE 10 2014 222 474 5/2016
DE 0 2016 203 056 8/2017
(Continued)

OTHER PUBLICATIONS

German Search Report dated Aug. 7, 2018.
Notice of Preliminary Rejection dated Jan. 7, 2020.
Japanese Examination Report dated Dec. 27, 2019.

*Primary Examiner* — George C Jin
*Assistant Examiner* — Teuta B Holbrook
(74) *Attorney, Agent, or Firm* — Gerald E. Hespos; Michael J. Porco; Matthew T. Hespos

(57) ABSTRACT

A method and device for water injection, wherein a water injector (104) is activated in accordance with an activation (200) to open at a first time (t1) and to close at a second time (t2), wherein a water pressure profile (300) is measured and a change in the water pressure profile (400) is determined on the basis of the water pressure profile (300), wherein, depending on the water pressure profile (300) and on the change in the water pressure profile (400), it is determined whether the water injector (104) has been opened as a result of the activation (200), and/or wherein, depending on the water pressure profile (300) and on the change in the water pressure profile (400), it is determined whether the water injection (104) has been closed as a result of the activation (200).

8 Claims, 2 Drawing Sheets

(51) Int. Cl.
*F02M 25/022* (2006.01)
*F02M 25/028* (2006.01)
*F02M 25/03* (2006.01)

(56) References Cited

U.S. PATENT DOCUMENTS 5,535,621 A * 7/1996 Glidewell ..... F02D 41/221 123/478
2009/0153337 A1* 6/2009 Cordesses ..... F02D 35/023 340/632
2012/0209544 A1* 8/2012 Takashima ..... F02M 57/005 702/50
2014/0216407 A1* 8/2014 Smith ..... F02D 41/22 123/446
2014/0325961 A1* 11/2014 Yokota ..... F01N 3/208 60/274
2014/0379238 A1* 12/2014 Riepl ..... F02M 63/028 701/103
2015/0167621 A1* 6/2015 Choi ..... F02D 41/062 123/179.3
2016/0102779 A1* 4/2016 Lang ..... F02D 41/20 123/294
2017/0074203 A1* 3/2017 Kober ..... F02M 51/06
2017/0321621 A1* 11/2017 Zimmer ..... F02D 41/401
2017/0328324 A1* 11/2017 Park ..... F02D 41/3863
2018/0023720 A1* 1/2018 Traversa ..... F02D 41/20 251/129.15
2018/0106189 A1* 4/2018 Obergfaell ..... F02B 47/02
2018/0223761 A1* 8/2018 Hirchenhein ..... F02D 41/221
2018/0283263 A1* 10/2018 Iijima ..... F02D 41/222
2019/0032590 A1* 1/2019 Conis ..... F02D 41/221
2019/0040820 A1* 2/2019 Taniel ..... B01F 3/0807
2019/0145313 A1* 5/2019 Hirchenhein ..... F02D 41/1497 701/102
2019/0234299 A1* 8/2019 Jost ..... F02M 25/028

FOREIGN PATENT DOCUMENTS

EP 0 787 900 8/1997
EP 0 825 341 2/1998
JP 9-49458 2/1997
JP 2011-102565 5/2011
JP 2012-225214 11/2012
JP 2015-098822 5/2015

* cited by examiner

METHOD AND DEVICE FOR WATER INJECTION

CROSS REFERENCE TO RELATED APPLICATION

This application claims priority under 35 USC 119 to German Patent Appl. No. 10 2018 101 773.1 filed on Jan. 26, 2018, the entire disclosure of which is incorporated herein by reference.

BACKGROUND

Field of the Invention

The invention relates to a method and a device for water injection, in particular into a combustion chamber or an intake pipe of an internal combustion engine.

Related Art

EP 0787 900 B1 and EP 0825341 B1 disclose a method for water injection in which changes in a water flow pressure are recorded to detect faults in the water injection system.

The object of the invention is to provide an improved water injection method.

SUMMARY

A method for water injection in accordance with the invention is made where a water injector is activated in accordance with an activation to open at a first time and to close at a second time. A water pressure profile is measured and a change in the water pressure profile is determined on the basis of the water pressure profile. Depending on the water pressure profile and the change in the water pressure profile, it is determined whether the water injector has been opened as a result of the activation, and/or depending on the water pressure profile and on the change in the water pressure profile, it is determined whether the water injector has been closed as a result of the activation. Depending on the result of the check, a downstream diagnostic function is enabled, for example, to permit reliable detection of a malfunction.

A fault may be detected if the water injector has been opened too early or too late.

A fault may be detected if the water injector has not been opened completely.

A fault may be detected if the water injector has been closed too early or too late.

A fault may be detected if the water injector has not been closed completely.

At least one of the following conditions may be checked:

a. does the water pressure profile exceed a first limiting value before the opening of the water injector, b. does a pressure gradient in the course of the change in the water pressure profile fall below a second limiting value within a first time window, c. does the water pressure profile fall below a third limiting value following the opening of the water injector, d. does a pressure gradient in the course of the change in the water pressure profile exceed a fourth limiting value within a second time window, e. does the water pressure profile exceed a fifth limiting value following the closure of the water injector.

These conditions permit particularly reliable detection of faults.

The water pressure profile may be recorded as a water pressure signal by means of a pressure sensor. The water pressure signal is low-pass filtered, and the change in the water pressure profile may be determined as a first derivative of the low-pass filtered water pressure signal. This permits particularly efficient signal processing.

Advantageously, the water pressure profile is measured as a water rail pressure profile in a water rail. Only one pressure sensor may be needed for water injection systems with a water rail.

The device may comprise a water injector, a pressure sensor and a control device. The control device may be designed to receive a water pressure signal from the pressure sensor and to activate the water injector in accordance with the method.

Further advantageous refinements can be gathered from the following description and the drawing.

DETAILED DESCRIPTION

Figure 1:
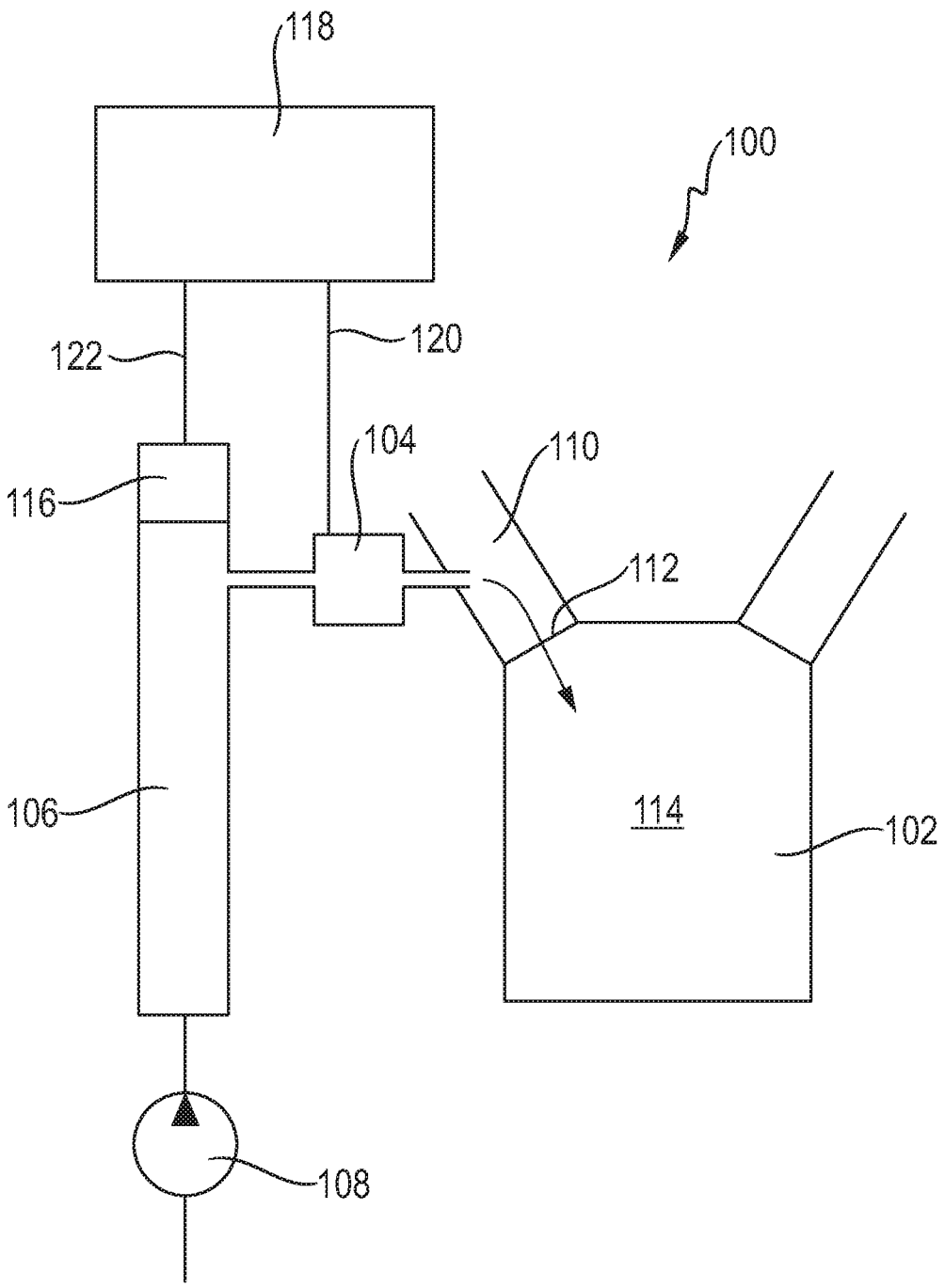
FIG. 1 shows, schematically, an internal combustion engine having water injection.

FIG. 1 is a schematic illustration of an internal combustion engine 100 having water injection. In this example, an internal combustion engine 100 having multiple cylinders 102 and a water injection system is provided. In FIG. 1, one of the cylinders 102 is illustrated. Water is injected into each of the cylinders 102 by a water injector 104. In the present example, there is at least one water injector 104 for each cylinder 102. The water injectors 104 are supplied via a water rail 106 with the water and a pressure of about 10 bar, generated by a water pump 108. The injection takes place in the example in an inlet channel 110, that is to say directly upstream of an inlet valve 112 for the cylinder 102.

In general, the injection of the water can also take place in an air manifold or in a combustion chamber 114 of the internal combustion engine 100. The location of the injection plays no role in the method described.

It is also possible for one water injector 104 to be used for the entire internal combustion engine 100. The injection then takes place into the air manifold.

In the combustion chamber 114, a fuel-air mixture also is provided in a conventional way as working gas for combustion.

During the water injection, evaporation enthalpy of water is used to cool charging air or the working gas and thus the combustion or the exhaust gases.

Additional cooling is effected by the water. As a result of this cooling, a knock limit of the internal combustion engine 100 is displaced. Gasoline engines can, for example, be operated with a higher compression ratio and/or earlier ignition points. This has a positive effect on the efficiency of the gasoline engine.

In the following text, a diagnostic strategy will be described that is capable of detecting a malfunction of the water injection system, in particular a failure of the water injection system or a deviation of a quantity of water supplied from an intended quantity of water.

A profile of a water rail pressure is monitored to check the functionality of the water injection system. More particularly, at least one pressure sensor 116 is arranged in the internal combustion engine. The pressure sensor 116 in this example measures a water pressure in the water rail 106. A control device 118 is connected to the water injector 104 via a first signal line 120 and to the pressure sensor 116 via a second signal line 122. The control device 118 comprises a microcontroller with instructions for evaluating pressure signals from the pressure sensor 116 and for activating the water injector 104, as described below. For example, a low-pass filtered water rail pressure signal and its first derivative with respect to time are evaluated.

Figure 2:
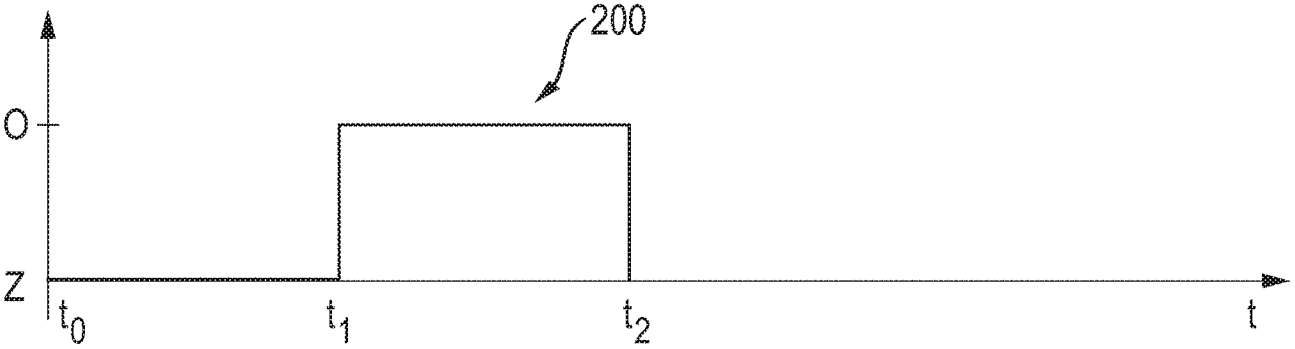
FIG. 2 shows, schematically, an activation of a water injector.

FIG. 2 shows, schematically, an activation 200 of the water injector 104 plotted against the time t. The activation 200 is predefined, for example, by the control device 118. In a first operating state Z, the water injector 104 is closed between a first time t0 and a second time t1. At the time t1, the water injector 104 is opened. The water injector 104 is then operated open in a second operating state O until a time t2. At the time t2 the water injector 104 is closed and is then operated closed in the first operating mode. This activation 200 can be repeated periodically.

Figure 3:
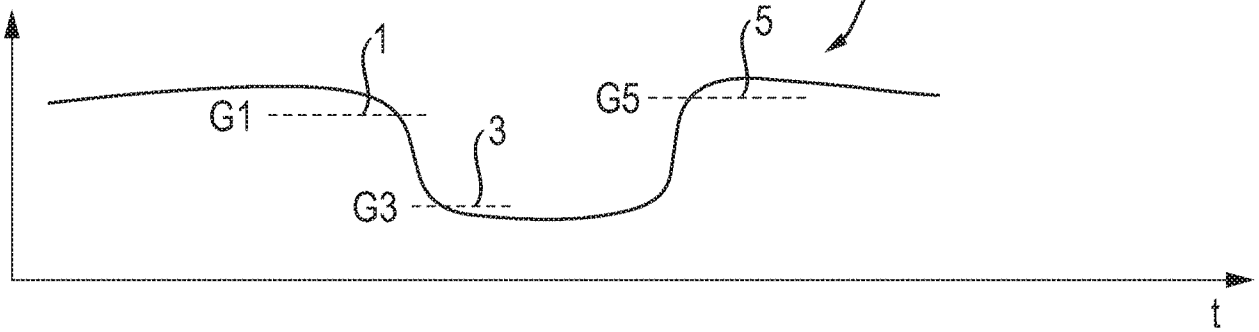
FIG. 3 shows, schematically, a water rail pressure profile.

During the activation 200 of the water injector 104, a water rail pressure profile 300 illustrated schematically over the time tin FIG. 3 is established. The water rail pressure profile 300 in FIG. 3 corresponds to the low-pass filtered water rail pressure signal that is recorded by the pressure sensor 116.

Figure 4:
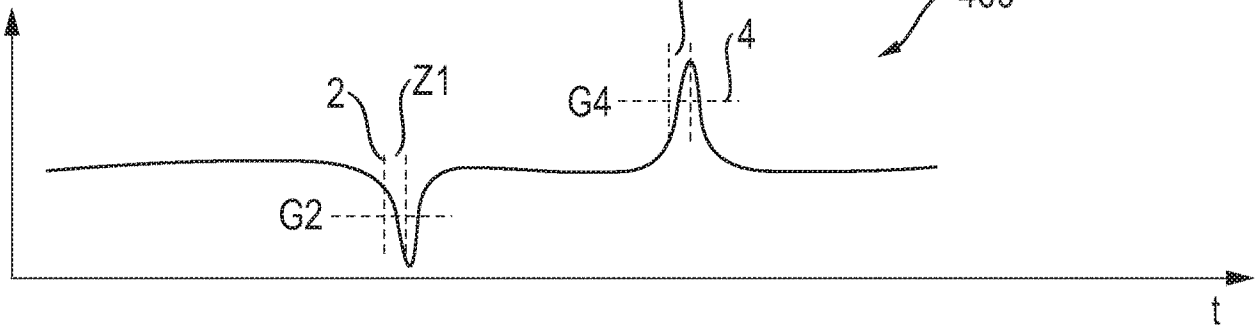
FIG. 4 shows, schematically, a profile of a first derivative of the water rail pressure profile.

FIG. 4 schematically shows a profile of a first derivative as a change 400 in the water rail pressure profile 300 according to FIG. 3 over the time t. The first derivative is determined, for example by the control device 118, from the low-pass filtered water rail pressure signal.

The water injection system can also be implemented without a water rail. Instead of a water rail pressure signal, a water pressure signal can be measured at a different point of the water injection system. To this extent, the method can be applied to a water pressure profile and to changes in the water pressure profile.

An injected quantity of water correlates with the period during which the water injection valve is open. The time t1 of an opening of the water injector 104 is determined by using a pressure drop in the water rail pressure. The time t2 of the closing operation of the water injector 104 is determined through a rise in the water rail pressure. By means of an interrogation of the conditions 1-3 described below, it is determined whether the relevant water injector 104 has been opened as a result of its activation. By means of the conditions 4 and 5 described below, a check is made as to whether the relevant water injector 104 has been closed as a result of its activation.

1. Does the water rail pressure profile 300 exceed a first limiting value G1 before the opening of the water injector 104?

2. Does a pressure gradient in the course of the derivative 400 exceed a second limiting value G2 within a first time window Z1, in particular immediately after the opening?

3. Does the water rail pressure profile 300 fall below a third limiting value G3 following the opening of the water injector 104?

4. Does the pressure gradient exceed a fourth limiting value G4 within a second time window Z2, in particular immediately after the closure?

5. Does the water rail pressure profile 300 exceed a fifth limiting value G5 following the closure of the water injector 104?

By using the conditions 1 to 3, a check is made as to whether the water injector 104 has been opened. If the water injector 104 has been opened too early or too late, in the example a fault is detected. If the water injector 104 has not been opened completely, in the example a fault is detected. By using the conditions 4 and 5, the check is made as to whether the water injector 104 has been closed. If the water injector 104 has been closed too early or too late, in the example a fault is detected. If the water injector 104 has been closed completely, in the example a fault is detected.

By using the five conditions, it is assessed whether the water injection system is functioning in accordance with required values. Depending on individual requirements, one, more or all of these conditions can be used for a diagnostic system. The limiting values and time windows are, for example, chosen depending on the water injection system and tolerances and stored in the control device 118.

For example, the diagnosis is carried out when the internal combustion engine 100 is started. The diagnosis can also be carried out during operation of the internal combustion engine 100.

What is claimed is:

1. A method for water injection, comprising:

a first step of providing a water injector (104) operable between an open state and a closed state;

a second step of measuring a water pressure profile (300) to confirm whether the water injector is in the closed state;

a third step of activating the water injector (104) in accordance with an activation (200) to open at a first time (t1) and to close at a second time (t2), a fourth step of confirming the water injector is in the open state by at least one of:

measuring a water pressure profile (300) at the first time (t1) to determine if the water pressure profile (300) exceeds a first limiting value (G1) and the water injector (104) is in the open state or if the water pressure profile (300) is less than the first limiting value (G1) and the water injector (104) is in the closed state, determining whether a pressure gradient in the course of a change in the water pressure profile (400) fall below a second limiting value (G2) within a first time window (Z1), and confirming whether the water pressure profile (300) falls below a third limiting value (G3) following the opening of the water injector (104), and a fifth step of determining whether the water injector (104) has been closed by at least one of:

determining if the pressure gradient in the course of the change in the water pressure profile (400) exceed a fourth limiting value (G4) within a second time window (Z2), and determining if the water pressure profile (300) exceed a fifth limiting value (G5) following the closure of the water injector (104).

2. The method of claim 1, further comprising detecting a fault if the water injector (104) has been opened too early or too late.

3. The method of claim 1, further comprising detecting a fault if the water injector (104) has not been opened completely.

4. The method of claim 1, further comprising detecting a fault if the water injector (104) has been closed too early or too late.

5. The method of claim 1, further comprising detecting a fault if the water injector (104) has not been closed completely.

6. The method of claim 1, further comprising recording the water pressure profile (300) as a water pressure signal by means of a pressure sensor (116), wherein the water pressure signal is low-pass filtered, and wherein the change in the water pressure profile (400) is determined as a first derivative of the low-pass filtered water pressure signal.

7. The method of claim 1, wherein the step of measuring the water pressure profile (300) comprises measuring a water rail pressure profile in a water rail (106).

8. A device for water injection, comprising a water injector (104), a pressure sensor (116) and a control device (118), wherein the control device (118) is configured to receive a water pressure signal from the pressure sensor (116) and to activate the water injector (104) in accordance with the method of claim 1.

* * * * *